US005087094A

United States Patent [19]

Rogers, Jr.

[11] Patent Number: 5,087,094

[45] Date of Patent: Feb. 11, 1992

[54] RECLINER CHAIR

[76] Inventor: Walter C. Rogers, Jr., P.O. Box 728, Denton, N.C. 27239-0728

[21] Appl. No.: 549,972

[22] Filed: Jul. 9, 1990

Related U.S. Application Data

[63] Continuation-in-part of Ser. No. 463,461, Jan. 11, 1990, which is a continuation-in-part of Ser. No. 361,309, Jun. 5, 1989, Pat. No. 4,915,444.

[51] Int. Cl.[5] ..... A47C 1/02

[52] U.S. Cl. ..... 297/68; 297/69; 297/85

[58] Field of Search ..... 297/68, 67, 70, 75, 297/76, 83, 89, 85, 86, 87

[56] References Cited

U.S. PATENT DOCUMENTS

| | | | |
|---|---|---|---|
| 27,645 | 3/1860 | McGregor | 297/68 |
| 3,244,448 | 4/1966 | Re | 297/85 X |
| 3,537,747 | 11/1970 | Rogers, Jr. | 297/85 |
| 4,017,118 | 4/1977 | Cawley | 297/75 X |
| 4,572,573 | 2/1986 | Yoshikawa et al. | 297/75 |
| 4,669,778 | 6/1987 | Rogers, Jr. | 297/85 |
| 4,678,229 | 7/1987 | Ryan et al. | 297/68 |
| 4,915,444 | 4/1990 | Rogers, Jr. | 297/68 |

*Primary Examiner*—Peter A. Aschenbrenner
*Attorney, Agent, or Firm*—William E. Mouzavires

[57] ABSTRACT

A recliner has a layer of upholstery fixed to the seat and extending continuously and fixed to a footrest frame which is moveable to a retracted position below the front end of the seat with the upholstery extending about and vertically below the front end of the seat. The footrest frame may include one or two ottoman boards mounted to a footrest linkage which will cause an ottoman board to pull the upholstery layer taut. In one embodiment, a pair of locking links are mounted to the footrest linkage and connected to each other for releaseably holding the footrest linkage in retracted position. In another embodiment where two ottoman boards are used, two pairs of conventional four bar linkages may be incorporated in the footrest linkage without sacrificing the desired contour of the upholstery.

11 Claims, 8 Drawing Sheets

RECLINER CHAIR

RELATED APPLICATION

This application is a continuation in part of my prior copending application Ser. No. 07/463,461 filed Jan. 11, 1990 and entitled Recliner Chair which in turn is a continuation in part of my prior application Ser. No. 07/361,309, filed June 5th, 1989 and entitled Recliner Chair and which has issued into U.S. Pat. No. 4,915,444.

BACKGROUND OF INVENTION

It has now become desireable to incorporate the CHAISE LOUNGER TM look into recliner chairs. With such a design, the upholstery covering extends continuously from the seat to the footrest. However standard footrest linkage systems have not been able to provide the necessary foot and leg support while at the same time accommodating or controlling the upholstery covering and padding when the footrest is in retracted position. This is because in one conventional styling, the upholstery dimension along the depth of the seat is 20½ inches and the vertical dimension from the seat surface to the bottom of the ottoman board of the footrest is 15½ inches making a total upholstery length of 36 inches. However when using standard footrest linkage mechanisms, the length dimension from the back of the seat to the front edge of the ottoman board in the extended or T.V. position of the legrest is 39 inches in order to provide the proper leg and foot support. If a 39 inch length pad is used, a 3 inch excess upholstery length results in the retracted position of the footrest when such standard linkage mechanisms are employed. This will cause wrinkling and bulging of the upholstery pad and cover detracting from the appearance. If a 36 inch length pad is used it will tear when moving to the extended position of the footrest.

One attempt to solve this problem uses elastic material sewn into the upholstery pad allowing the upholstery to stretch when in extended position and to contract when in the retracted position. This requires that the cover pad be sewn all the way into an underlying bonded fiber pad to ensure permanent placement however this increases the cost of manufacture. Moreover the elastic material approach does not necessarily totally solve the aforementioned problem.

OBJECTS OF THE INVENTION

The present invention relates to recliner chairs and more specifically to a recliner chair having a novel footrest system which may be used with upholstery that extends from the seat to an ottoman board included in the footrest system. Included herein is a novel footrest system which will overcome the aforementioned problem.

Another object of the present invention is to provide a novel and improved footrest system for a recliner chair which may utilize a standard linkage mechanism and yet provide desired styling requirements mentioned above.

Another object of the present invention is to provide a recliner chair having a novel footrest arrangement providing a continuous support surface between the seat and the footrest proper and which, at the same time, is capable of pulling or tensioning the support surface to remove wrinkles and bulges when in the retracted position.

Another object of the present invention is to provide a footrest system incorporating an improved linkage for extending and retracting the footrest and for controlling upholstery extending from the seat to the footrest ottoman board.

DRAWINGS

Other objects and advantages of the present invention will become apparent from the following more detailed description taken in conjunction with the drawings in which.

SUMMARY OF INVENTION

In summary the present invention provides a leg and footrest support system in a recliner chair which system includes a support extending from the seat to the footrest while wrapping or curling or convexly extending around the front of the seat when the chair is in closed position. The support includes a layer such as a pad which is connected to the seat and extends and is connected to at least one "ottoman board" included in the footrest. The system further includes a linkage system mounting the ottoman board to the chair for movement between extended and retracted position. The linkage system also serves to pull or tension the support pad to take up slack when the ottoman board is in retracted position.

In one embodiment of the present invention, the system includes a single ottoman board movable into a retracted position below and inwardly of the seat with the linkage located between the ottoman board and the seat. In another embodiment the system includes two ottoman boards. In the retracted position one board extends generally vertically below the seat and the other board is positioned rearwardly of the first board and with the support pad overlying the one board and connected to the other board. In yet another embodiment the support pad 13 connected to the one board which extends vertically below the seat but is not connected to the other board which however is provided with its own support pad.

DETAILED DESCRIPTION

Figure 1:
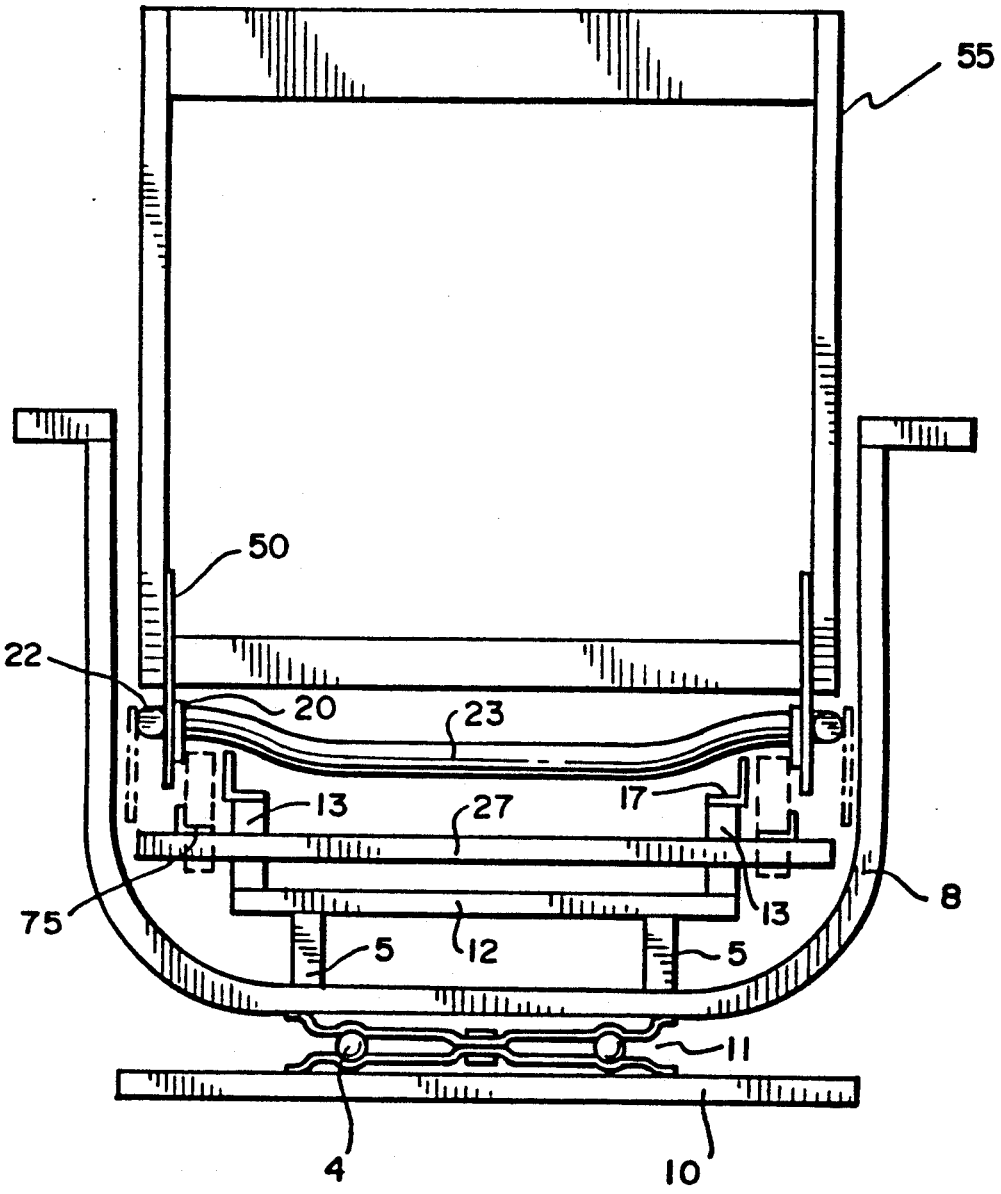
FIG. 1 is a front elevational view of a reclining chair embodying the present invention and with its upholstery removed.
Figure 2:
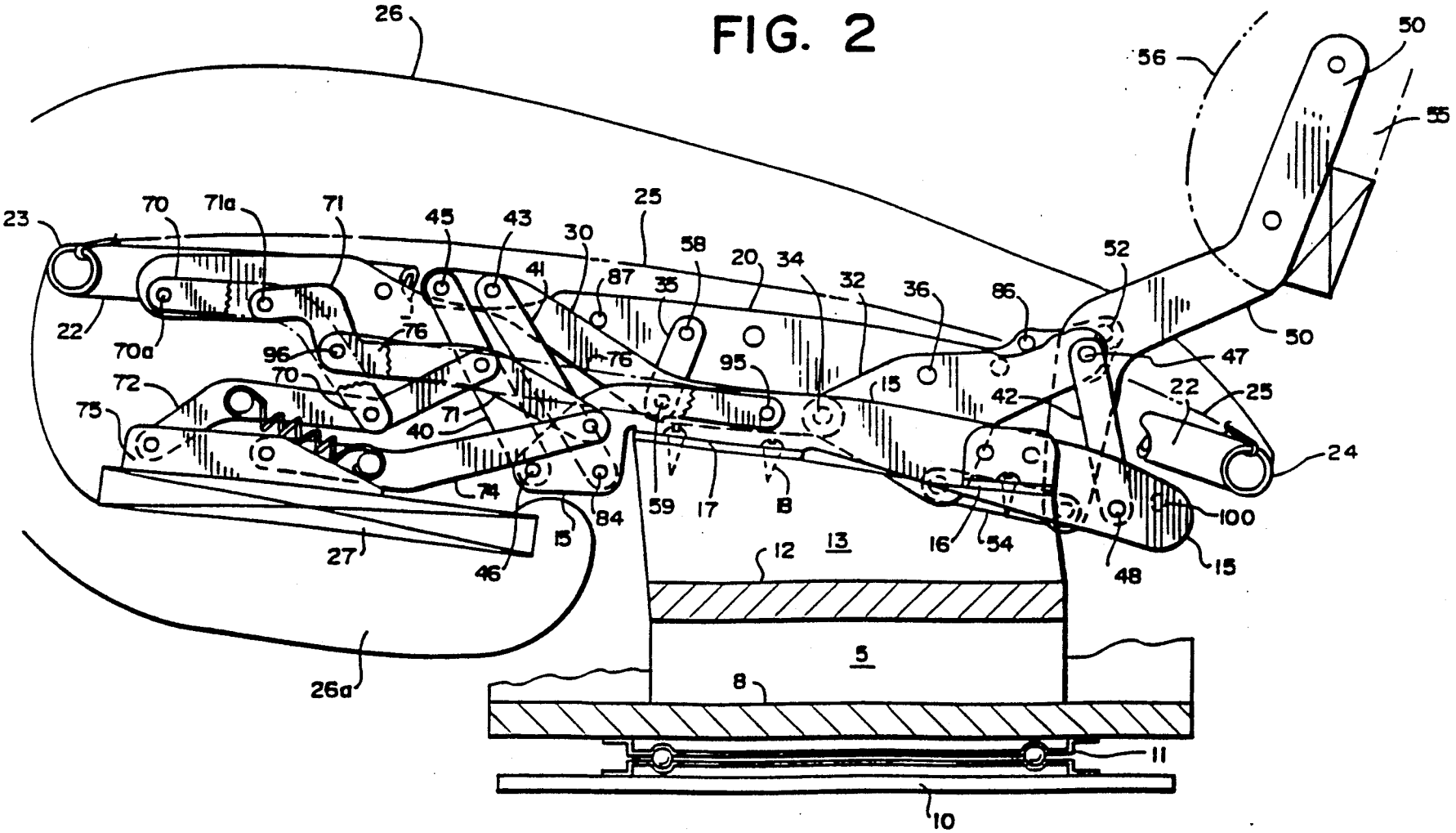
FIG. 2 is a side elevational view of the chair when in the closed or generally upright position and with portions of the backrest and links broken away.

Referring to FIGS. 1 and 2, a recliner chair embodying the present invention includes a base 10, an armrest frame 8 mounted on base 10 by a swivel assembly 11 including ball bearing 9. Armrest frame 8 includes a cross member or stretcher 12 extending between opposite sides thereof and fixed on blocks 5 which are fixed on the base of the armrest frame. Fixed on the stretcher 12 are a pair of laterally spaced mounting blocks 13 for mounting a base link 15 by means of flanges 16 and 17 and screws 18 as shown in FIG. 2.

Base link 15 extends in the forward-rearward direction of the chair and supports front and rear carrier links 30, 32 by means of mounting links 40 and 42 each pivotally interconnected at its opposite ends to a carrier link and base link such that the carrier links are swingable relative to the fixed base link. In this regard, link 40 is pivoted at 45 and 46 to carrier and base links 30 and 15 while link 42 is pivoted at 47 and 48 to carrier and base links 32 and 15. Carrier links 30, 32 are also pivotally connected to each other at pivot 34.

Carrier links 30, 32 support the seat of the chair which seat includes a seat link 20 extending in the forward-rearward direction of the chair where it is fixed to the seat frame including side tubes 22 and front and rear cross tubes 23, 24 made of structural steel in the specific embodiment shown. The seat link is mounted to the front carrier link 30 by means of a link 35 pivotally connected therebetween at pivots 58 and 59. Seat link 20 is pivotally mounted by pivot 36 directly to the rear carrier link 32.

The seat of the chair includes, in the shown embodiment, a sinuous wire layer 25 extending between the seat frame and a layer of upholstery 26 which may include a foam cushion layer and other conventional upholstery materials. However, in accordance with one of the features of the invention, the upholstery layer is attached to the seat frame and extends continuously from the seat to the footrest frame 26 (which in the art is at times referred to as "ottoman board") to which it is attached and which extends below the front of the seat in a generally horizontal plane such that the upholstery 26*a* at the front of the seat wraps or curls around and under the front of the seat as shown in FIG. 2. Moreover, the linkage is arranged such that when the footrest is extended, the upholstery layer will extend continuously without sagging between the seat and footrest to provide a continuous contoured leg support surface and when the footrest is retracted the linkage will pull the layer taut to remove any slack in the layer.

Figure 3:
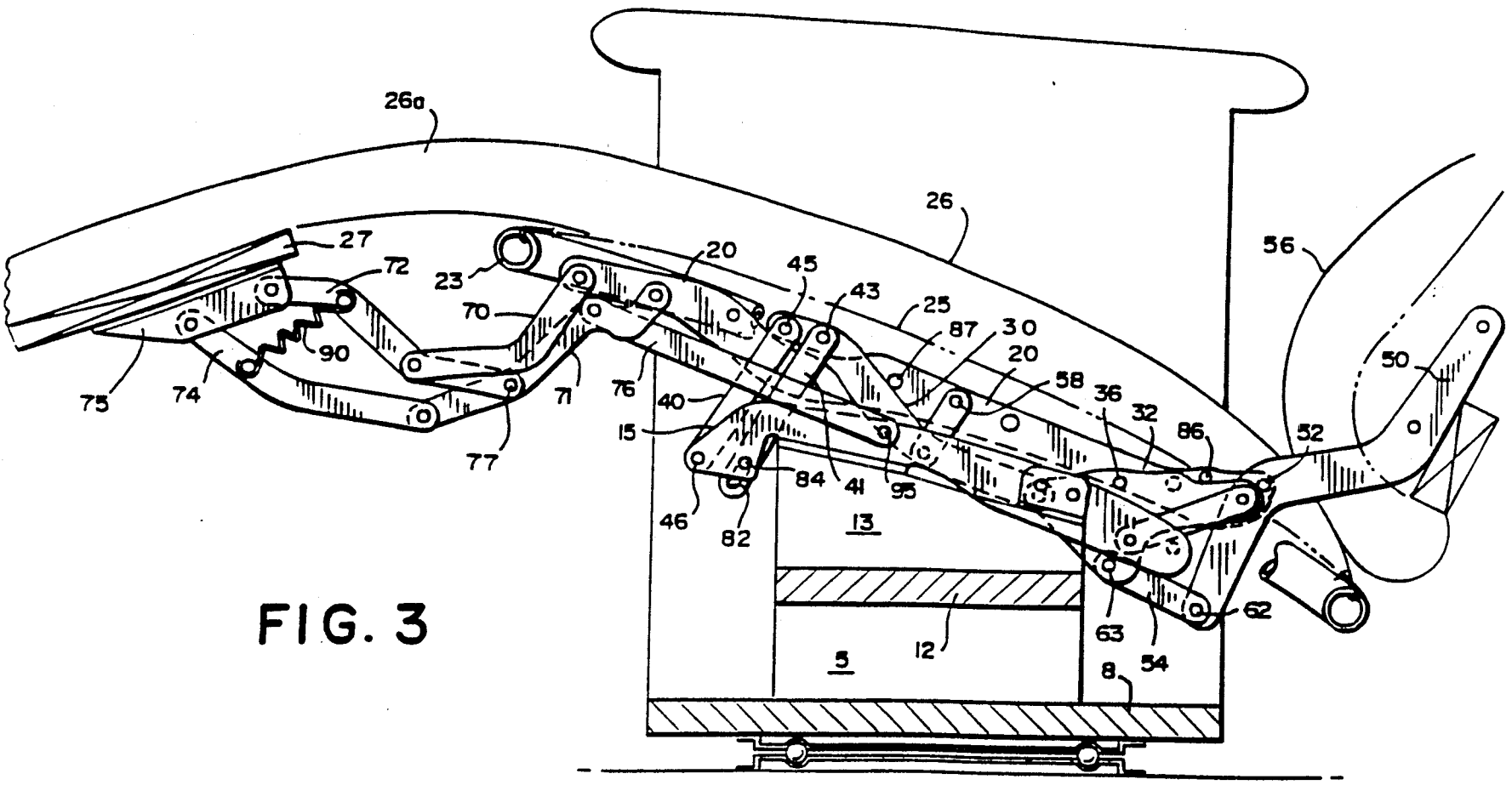
FIG. 3 is a view generally similar to FIG. 2 but with the chair shown in the TV position.

The backrest of the chair is, of course, positioned at the rear of the seat and includes a backrest link 50 fixed to the backrest frame 55 and pivoted at 52 to the rear end portion of seat link 20. Backrest frame 55 is covered by suitable upholstery 56. As shown in FIG. 3, the lower end of backrest link 50 is pivotally connected at 62 to the rear of a thrust link 54 having its forward end pivotally connected at 63 to the rear carrier link 32 at a lower portion thereof below pivot 36. Thrust link 54 functions to pivot the rear carrier link 32 when the chair is moved to advanced reclining position by exerting pressure against the backrest to pivot backrest link 50 rearwardly about pivot 52 which drives thrust link 54 forwardly to pivot carrier link 32 clockwise (as shown in FIG. 2) and which causes the seat to be moved upwardly and rearwardly relative to the base link.

The above movement is achieved after the chair is in TV position shown in FIG. 3. However, when the chair is in the closed position shown in FIG. 2, movement of the backrest relative to the seat is prevented by a sequencer link 41 in accordance with another aspect of the present invention. Sequencer link 41 has its upper end pivotally connected at 43 to a forward portion of front carrier link 30 and in its lower portion a slide 82 receives a pin 84 fixed to the base link 15. When the linkage system is in the closed position shown in FIG. 2, pin 84 will engage in the bottom of slide 82 to prevent movement of the front carrier link 32 and seat link 20 which, of course, will prevent movement between the seat and backrest. However, when the chair moves towards TV position, pin 84 will become spaced (see FIG. 3) from the bottom of slide 82 to allow the advanced reclining movement described above. Note from FIG. 4 that in the fully reclined position, pin 84 engages in the bottom of slot 82.

Figure 4:
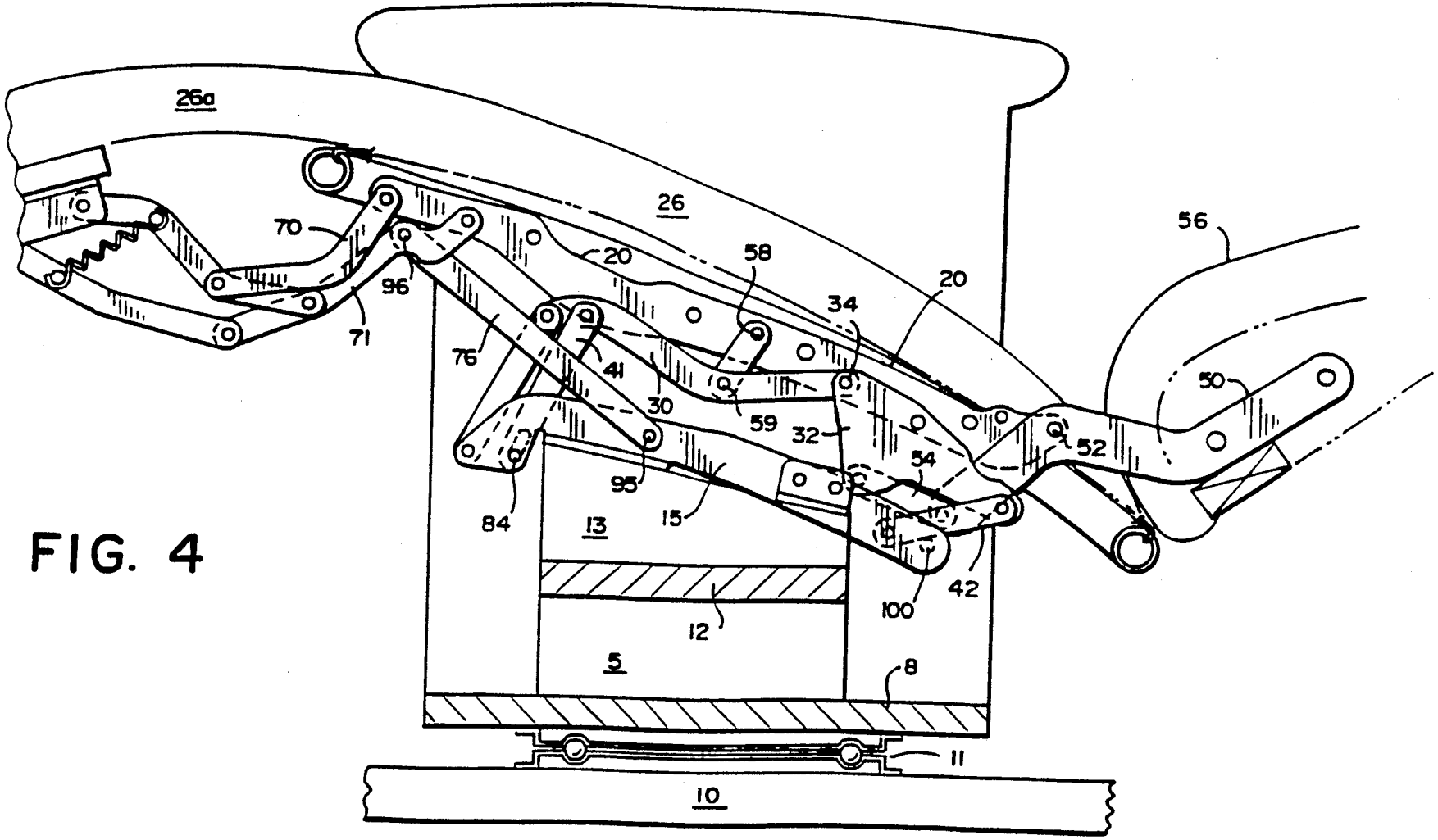
FIG. 4 is a view generally similar to FIG. 3 but with the chair shown in the fully advanced reclining position.

The footrest linkage in the shown embodiment includes a pair of mounting links 70 and 71 having their upper ends pivotally mounted to the seat link 20 at spaced locations at the front of the seat as shown at pivots 70*a* and 71*a*. Links 70 and 71 are pivotally connected to a pair of links 72 and 74 which, in turn, are connected to an ottoman link 75 which is fixed to an ottoman frame shown as a board 27. Link 71 is also pivotally connected at 77 to link 72. The footrest linkage is arranged with respect to the seat such that the ottoman link 71 and board 27, when closed or retracted, will be positioned generally horizontally below the seat and rearwardly of the front of the seat as shown in FIG. 2. The footrest is biased in closed position by a coil spring 90. Also, when the footrest is extended such as shown in FIGS. 3 or 4, the seat and footrest upholstery extends continuously in one layer without interruption or separation at the juncture of the seat and footrest mechanism. This not only provides a highly attractive appearance, it also enhances user comfort by allowing the contour of the seat and footrest upholstery to match the contour of the user.

Actuation of the footrest and chair between the closed position shown in FIG. 2 to the open or TV position shown in FIG. 3 is achieved by the occupant grasping the armrests and pushing rearwardly with the back against the backrest. This will cause the seat 20 to move rearwardly relative to the base link 15 while also swinging upwardly at the front and downwardly at the rear to change pitch as shown in FIG. 3. A footrest control link 76 is pivoted at its rear at 95 to the base link 15 and at its front at 96 to footrest mounting link 71. Upon movement of the seat relative to the base rearwardly when moving in the TV position, control link 76 allows the footrest link 71 to pivot towards open position by the action of the seat link 20 thereon. Opening of link 71 causes the entire footrest linkage to move to extended or TV position shown in FIG. 3. In order to retract the footrest to closed position, pressure is applied with the legs on the footrest in conventional manner.

In order to move the chair to an advance reclining position beyond TV position towards full recline position of FIG. 4, the occupant exerts pressure against the backrest and the thrust link 54 pivots the rear carrier link 32 clockwise as shown in FIG. 3 which causes the front carrier link 30 to pivot counterclockwise about pivot 34. The result is that the pitch and elevation of the seat relative to the base is increased in the full recline position shown in FIG. 4. Such action not only places an occupant in a comfortable position but it also establishes a balance in the linkage enabling the reclining position to be maintained by the balance of the linkage under the occupant's weight. A stop 100 is fixed to base link 15 to engage mounting link 42 to determine the full recline position shown in FIG. 4 To return the chair to TV position of FIG. 3 from an advance reclining position, the occupant merely removes pressure from the backrest whereupon the redistribution of the occupant's weight will return the linkage to the TV position shown in FIG. 3. The position of the carrier links 30, 32 when the mechanism is in the closed or TV position, is determined by stops 86 and 87 fixed to the seat link 20 and engageable with the carrier links 30, 32 as shown in FIGS. 2 and 3.

Figure 5:
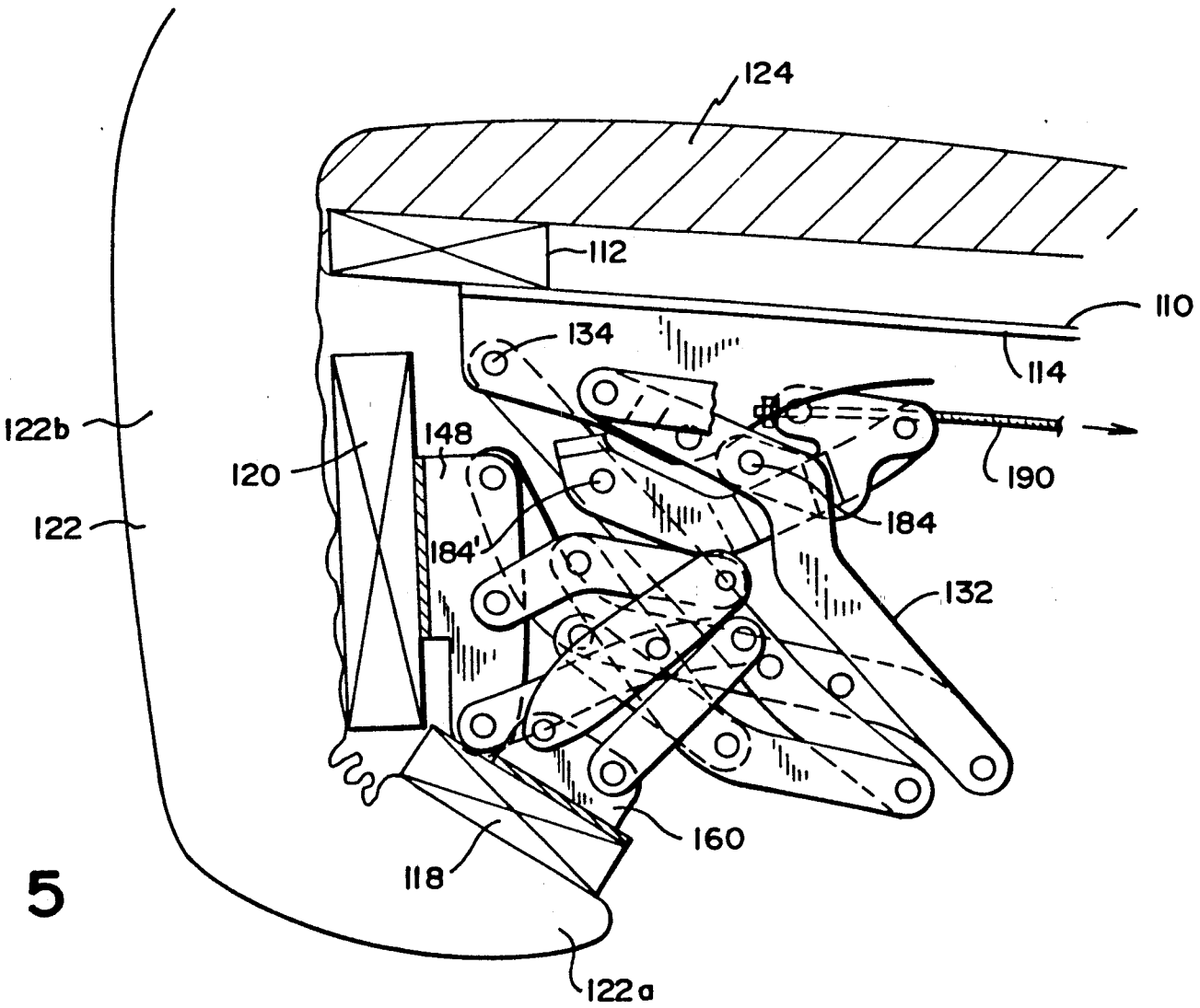
FIG. 5 is a side elevational view with portions broken away of a footrest system constituting another embodiment of the present invention and shown with the footrest in closed position.
Figure 6:
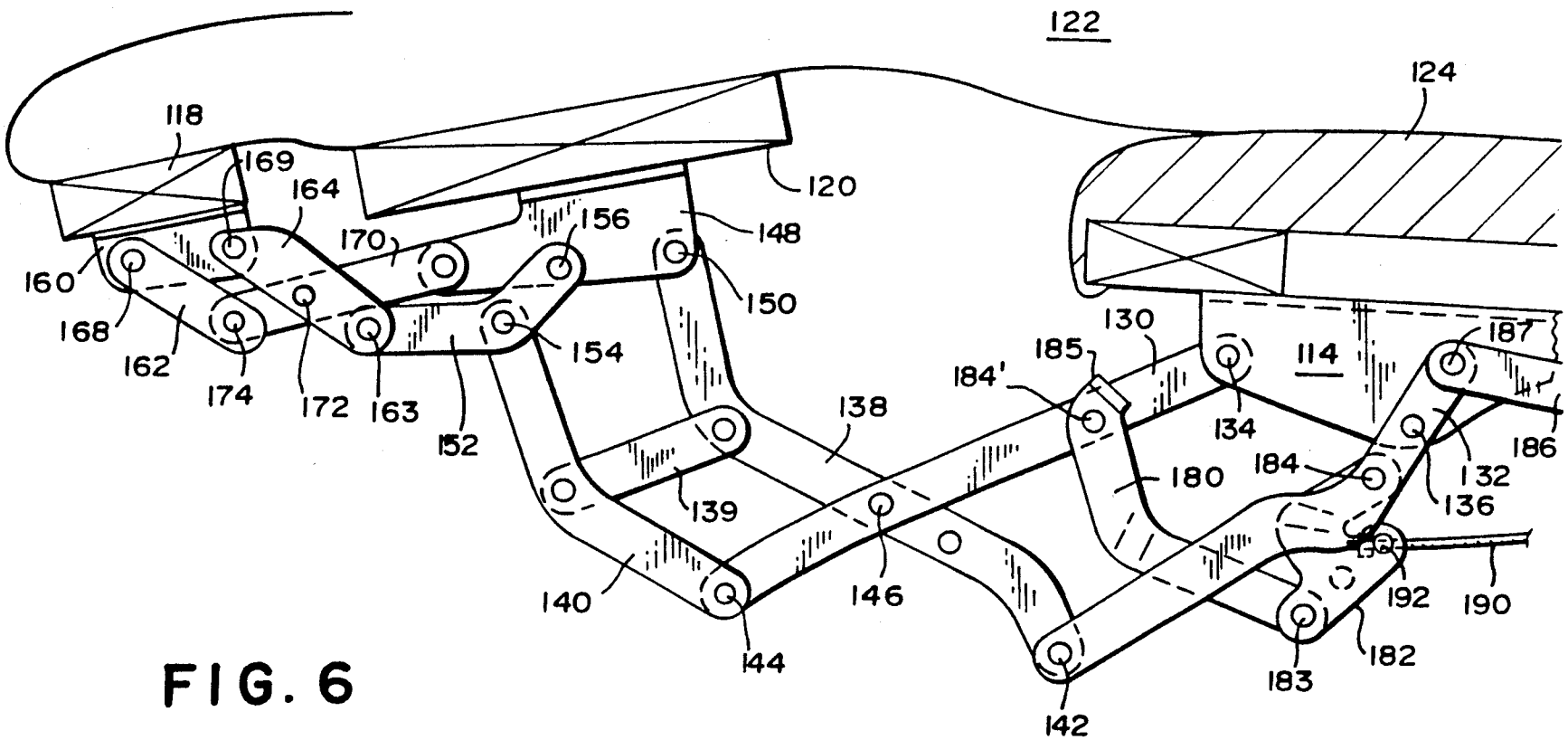
FIG. 6 is a view generally similar to FIG. 5 but showing the footrest in extended position.

Referring now to FIGS. 5 and 6, there is shown another embodiment of the footrest system of the present invention applied to a recliner chair having a seat frame including a siderail 110 and a frontrail 112 mounted to a seat link 114 as shown in FIG. 5. In this embodiment, the footrest frame includes two portions (two ottoman boards) 118 and 120 shown in the closed position in FIG. 5 and in the open or extended position in FIG. 6. As in the above described embodiment, a cover or upholstery 122 is connected or otherwise secured to the ottoman board 118 and extends continuously from the ottoman board 118 to the seat to which it is also connected or secured. In the specific embodiment shown, the upholstery 122 includes an outer covering layer and any suitable padding and furthermore below the upholstery layer 122 another layer of padding 124 may be provided as indicated in FIGS. 5 and 6. In the extended position of the footrest such as when the chair is in the TV position or in any advanced reclining positions, the upholstery 122 extends continuously from the seat of the chair to the second ottoman board 118 providing a continuous leg and foot support surface which is also attractive due to its continuous planar surface effect and smooth lines. In the closed position of the footrest when the chair is in the closed position, the lower ottoman board 118 will pull and tension the upholstery layer **122*a* such that it extends downwardly at the front of the chair below the seat and then inwardly below the front edge of the seat as shown in FIG. 5. This positions the upholstery layer while removing slack or wrinkles to thus present a smooth or continuous tailored appearance. The footrest mechanism as well as the seat mechanism and the upholstery are designed such that in the extended position of the footrest such as shown in FIG. 6, the upholstery layer 122 will extend continuously between the seat and the lower ottoman board 118 without drooping or sagging. At the same time the upholstery layer 122 will still wrap around the front of the seat as shown in FIG. 5** when the footrest is retracted.

Although the linkage mechanism for mounting and actuating the seat and backrest are not shown in FIGS. 5 and 6 any suitable mechanism may be employed for example see applicant's prior U.S. Pat. No. 4740031 issued Apr. 26, 1988 and entitled MECHANISM FOR A RECLINING CHAIR OR SOFA MODULE the disclosure of which is incorporated in its entirety into the present application and made a part hereof.

In accordance with another aspect of the present invention, a novel footrest linkage is employed for mounting the footrest ottoman to the chair for movement between the retracted and extended positions shown in FIGS. 5 and 6. In the preferred embodiment shown, the footrest linkage includes footrest mounting links 130 and 132 pivotally mounted by pivots 134 and 136 to the seat mounting link 114 as best shown in FIG. 6. In the fashion of a lazy tong linkage, mounting links 130 and 132 are pivotally connected to links 138 and 140 by means of pivots 142 and 140 while mounting link 130 is also pivotally connected by pivot 146 to link 138. In addition a control link 139 is pivotally mounted at its opposite ends to intermediate portions of links 138 and 140 as best shown in FIG. 6. Ottoman board 120 is suitably secured to a bracket link 148 which in turn is pivotally mounted by pivot 150 to the outer end portion of link 138. Bracket link 148 is mounted to the link 140 by means of a crank link 152 having one end mounted by pivot 156 to the bracket link 148 and an intermediate portion pivotally mounted by pivot 154 to link 140. It will be seen that the linkage including bracket link 148 links 138, 140 link 152 (the portion between pivots 154 and 156) and link 130 (the portion between pivots 144 and 146) provide a five bar linkage for not only mounting the ottoman board for movement and actuation between its positions, but also for mounting and actuating the other ottoman board 118 between its positions. In this latter regard, in the specific embodiment shown, ottoman board 118 is secured to a bracket link 160 which is mounted to a link 170 by means of links 162 and 164. Link 162 is pivotally connected at pivot 168 to bracket link 160 and pivotally connected by pivot 174 to one end of link 170. Link 164 is pivoted by pivot 169 to the bracket link 16 and has its opposite end pivoted by pivot 163 to crank link 152.

The aforementioned linkage allows the ottoman board 118 to be swung from its retracted position shown in FIG. 5 downwardly, forwardly and upwardly into its extended position of FIG. 6 without the ottoman board 118 or the surrounding upholstery section **122*a* striking the floor. This is uniquely achieved without requiring the seat height of the chair to be increased or without sacrificing the distance of extension of the footrest in the TV position shown in FIG. 6. At the same time the ottoman board 118 still is able to perform its function of wrapping the upholstery layer 122 about the front of the seat and below the front of the seat as in the preferred embodiment. Although in the preferred embodiment the outermost section 122*a* of the upholstery 122 adjacent the ottoman board is shown as being located under the seat, in other embodiments the outer most section or end of the upholstery layer may terminate short of reentry under the seat as long as the midsection 122*b* of the upholstery extends downwardly below the level of seat as shown in FIG. 5**.

In accordance with another aspect of the present invention, the footrest is held in the retracted or closed position shown in FIG. 5 by means of a lock mechanism which constitutes an improvement over the lock mechanism disclosed in applicant's prior U.S. Pat. Nos. 4,350,386 issued Sept. 21, 1982, 4,350,387 issued Sept. 21, 1982, and 4,418,957 issued Dec. 6, 1983 and entitled RECLINING CHAIR WITH IMPROVED ACTUATION. The disclosures of each of these patents are hereby incorporated by reference into the subject application as part hereof.

In the presently described embodiment of FIGS. 5 and 6, the locking mechanism includes a pair of locking links 180 and 182 which may also be termed "knuckle links". Locking links 180 and 182 are respectively pivotally mounted to footrest mounting links 130 and 132 by pivots 184 and 184'. In addition knuckle links 180 and 182 are pivotally interconnected to each other by pivot 183 as best shown in FIG. 6. In the closed position of the footrest shown in FIG. 5, the pivots 184, 184' and 183 will be substantially aligned on a straight line and the locking links 180 and 182 will prevent movement of the footrest linkage to extended position. This in turn of course prevents the entire seat mounting linkage from moving to the TV position. Depending on the particular seat linkage system employed, the footrest linkage may be urged to extended position either by gravity derived from the weight of the occupant of the seat or by a spring mechanism. In either case the locking links 180 and 182 when in the position shown in FIG. 5 will prevent opening of the footrest linkage as long as the pivots 184, 184' and 183 are in alignment or on center as generally shown in FIG. 5. In order to release the footrest linkage to allow the footrest to move to extended position, it is necessary to move the locking links 180 and 182 out of the position shown in FIG. 5 so that the pivots 183, 184 and 184' are no longer on center. This may be done in any suitable manner by rotating the locking link 182 clockwise as viewed in FIG. 5 in which event the biasing force imposed on the footrest linkage through the link 186 pivotally connected at 187 to the footrest mounting link 132 as shown in FIG. 6 will be effective to swing the footrest mounting links 130 and 132 clockwise as viewed in FIGS. 5 and 6 to extend the footrest mechanism.

In order to move the locking links 180 and 182 to release their hold on the footrest linkage, any suitable mechanism may be employed for rotating the locking links 180 and 182 clockwise from the closed or holding position of FIG. 5 to the open or released position of FIG. 6. In the specific embodiment shown, a cable 190 is connected to link 182 at 192 such that in the closed position of the footrest linkage shown in FIG. 5, once the cable 190 is pulled in the direction of the arrow, it will rotate the locking link 182 in a clockwise direction. Although not shown, cable 190 may be connected to a pushbutton actuator for initiating the release of the locking links. In an alternative embodiment not shown, a link may be pivotally connected to the locking link 182 to rotate the same clockwise out of the position of FIG. 5 for releasing the footrest mechanism. As noted above, once the locking links 180 and 182 are moved to the released position, the footrest linkage is moved to the extended position by either gravity and/or a spring mechanism which impose a force acting through link 186 to rotate the footrest mounting link 132 in a clockwise direction as viewed in FIG. 6.

In accordance with another feature of the present invention, one of the locking links, preferably 180, is employed for attaching a torque member or torque tube at 185 to extend between the linkage mechanisms on opposite sides of the chair. It will be understood that the associated recliner chair will include linkage mechanisms on the opposite sides of the chair which mechanisms are mirror images of each other and need not be described in duplicate. The torque tube will extend from a flanged portion 185 of locking link 180 to a similar portion on the locking link at the opposite side of the chair.

In the above described embodiments the footrest mounting linkage mechanisms are designed to tension the upholstery pads to remove wrinkles and bulges when the footrest is in retracted position. This is achieved through the use of novel linkage mechanisms which position the ottoman board to pull the pad downwardly in tension as the board moves into its retracted position.

In one aspect the present invention may also be applied with a footrest mounting linkage incorporating a conventional pair of four bar linkages. This is illustrated by the embodiment shown in FIGS. 7 and 8 of the drawings. The footrest linkage in this embodiment includes a first pair of generally parallel mounting links 230, 232 pivotally mounted at one end to the seat mounting link 234 which in the shown embodiment is fixed to the seat frame 210. A second pair of generally parallel links 236, 238 are pivotally mounted to the first pair 230, 232 and pivotally connected to a link 244 so that two four bar linkages are provided by these links in conventional fashion. This allows conventional mechanisms to be employed for this part of the footrest system. The system further includes two ottoman boards or footrest frames 218 220. Board 220 has fixed thereto a mounting bracket or link 240 while board 218 also has fixed thereto a mounting bracket or link 242. The latter is pivotally mounted to link 244 of a second four bar linkage 230, 236, 238 and 244. The other bracket link 240 is pivotally mounted to a link 252 which is pivotally mounted at pivot 270 to link 236. Bracket link 242 is also pivotally mounted by a link 256 to link 252. A link 254 interconnects link 242 (at pivot 272) and link 252. The pivot 272 also interconnects link 242 and link 244 as described above. The mounting of bracket link 240 is completed by a link 258 pivotally mounted at pivot 279 to link 254 and pivotally connected to bracket link 240 at pivot 285.

The upholstery pad 222 which of course includes the outer covering is secured to and overlies the seat frame 210 including an under pad layer 224. In addition the pad 222 extends continuously to the ottoman board 220 where it is attached generally at **222*b*** to the ottoman board.

The pad 222, **222*b* thus extends around the front end of the seat and then downwardly below the front end of the seat terminating preferably about 2" (inches) from the floor surface 290. In this position the pad 222, 222*b*** is held with a certain degree of tension or tautness by the footrest linkage system so that an attractive tailored or contoured look is achieved free of wrinkles or bulges in the pad.

Figure 7:
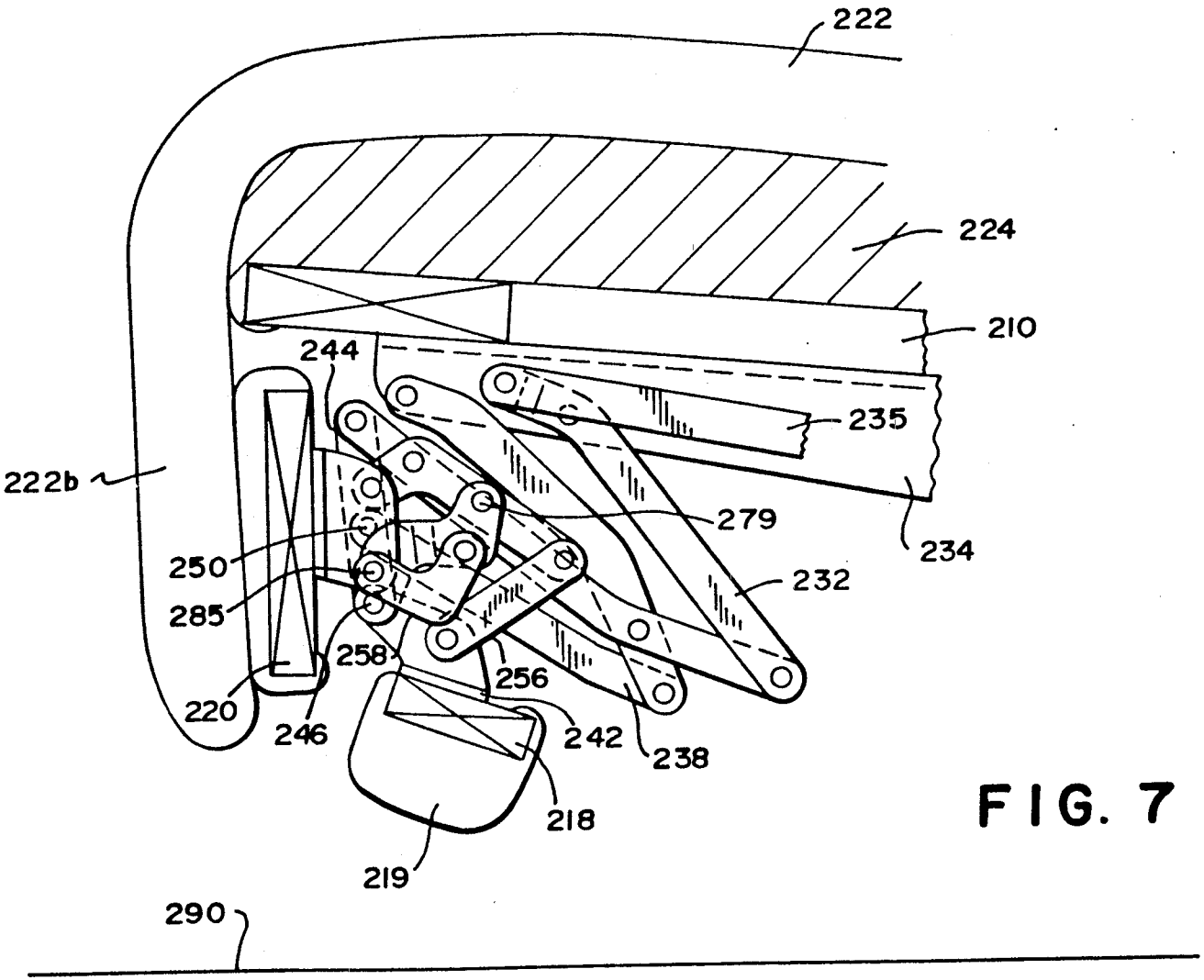
FIG. 7 is a side elevational view with portions broken away of a footrest system constituting another embodiment of the present invention and shown in the retracted position.
Figure 8:
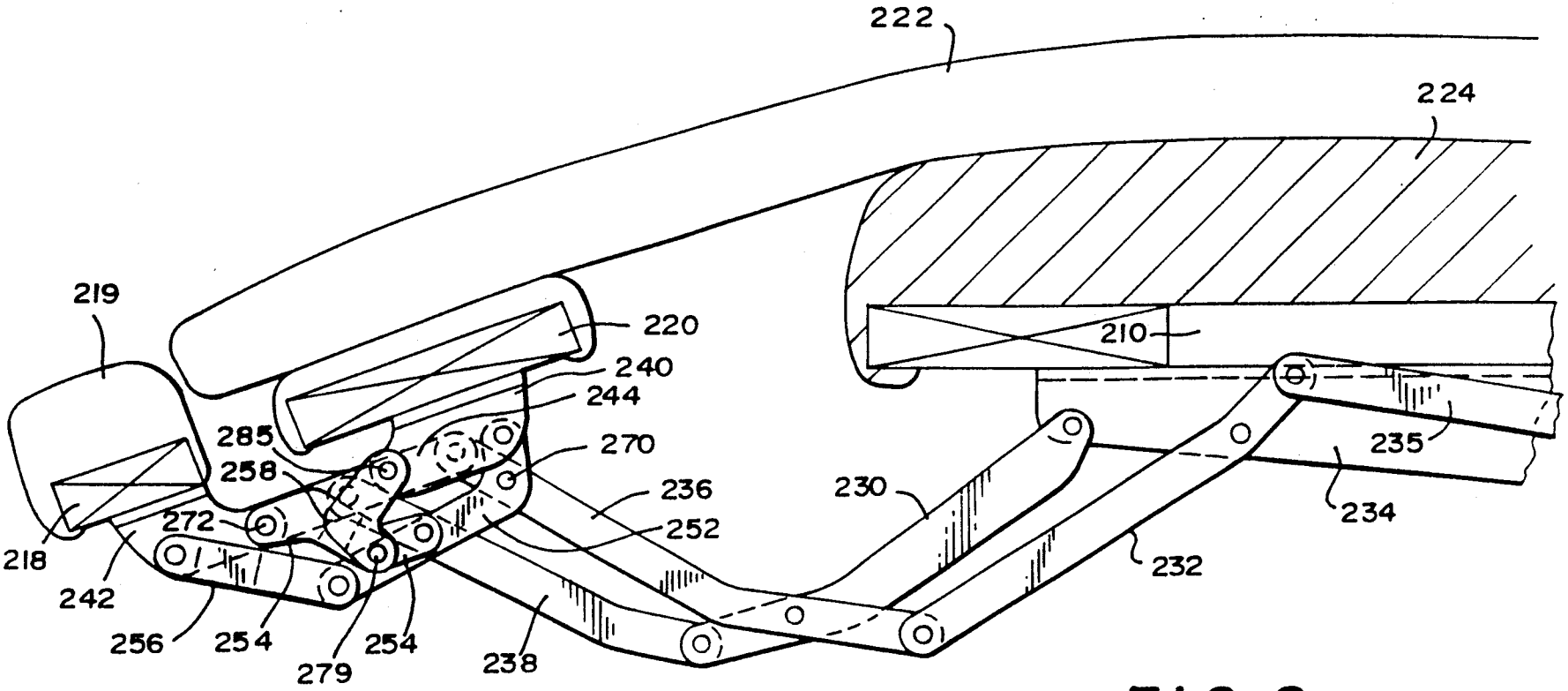
FIG. 8 is a view of the footrest system of FIG. 7 but shown in the extended position.

The other ottoman board 218 is located rearwardly of the board 220 at the lower edge portion of board 220 and of course is spaced above the floor surface 290 as shown in FIG. 7. Ottoman board 218 is provided with its own upholstery 219 including a pad which is dimensioned to lie at its surface in the same plane as that of pad **222*b* when the footrest in moved to extended position shown in FIG. 8. During this movement the ottoman board 218 will pivot in a clockwise direction as viewed in FIG. 7 to the position shown in FIG. 8. This will provide the required support beyond that provided by pad 222, 222*b* without detracting from the contoured look of pad 222*b* while in the extended or retracted position. This will also eliminate the necessity of using elastic material to remove wrinkles or bulges from the pad 222, 222*b* and at the same time allow the above described conventional four bar linkages to be employed to mount and activate the footrest ottomans. Actuation of the linkage is through an actuator link 235 which may be actuated as described above or by any other suitable means or manner. Also, although not shown in FIGS. 7 and 8 a locking mechanism and torque tube as described above in connection with FIGS. 5 and 6 may be incorporated in the mechanism of FIGS. 7 and 8**.

Other various modifications of the present invention will become apparent to those having ordinary skill in the art, however such modifications will not depart from the scope of the present invention indicated in the appended claims.

What is claimed is:

1. A recliner chair comprising in combination a basic support, a seat and backrest, a linkage system mounting the seat and backrest on the basic support, a footrest linkage mounted at the front of the chair for movement between retracted and extended positions, a footrest including a first frame connected to the footrest linkage to move between a retracted position located below the seat and inwardly of the front end of the seat and an extended position projecting forwardly from the front end of the seat, a second footrest frame connected to the footrest linkage between the first frame and the seat, a first layer of upholstery overlying and connected to the seat and extending and connected to the second frame to provide a leg and foot support surface when the footrest is in extended position and extending about the front end of the seat and below the seat when the footrest is in retracted position, and a second layer of upholstery connected to said first frame, and wherein said linkage when moved into retracted position pulls the first layer downwardly to remove slack in the first layer.

2. The recliner chair defined in claim 1 wherein said first frame is located rearwardly of a bottom edge of said second frame when the footrest is in retracted position.

3. A recliner chair comprising in combination a basic support, a seat and backrest, a linkage system mounting the seat and backrest on the basic support, a footrest linkage mounted at the front of the chair for movement between retracted and extended positions, a footrest including a first frame connected to the footrest linkage to move between a retracted position located below the seat and inwardly of the front end of the seat and an extended position projecting forwardly from the front end of the seat, a second footrest frame connected to the footrest linkage between the first frame and the seat, a first layer of upholstery overlying and connected to the seat and extending and connected to the second frame to provide a leg and foot support surface when the footrest is in extended position and extending about the front end of the seat and below the seat when the footrest is in retracted position said upholstery layer being exposed to view at the front of the chair below the seat when the footrest is in retracted position.

4. The recliner chair defined in claim 3 further including means including a pair of locking links pivotally mounted on the footrest linkage and interconnected to each other for releasably holding the footrest linkage in retracted position.

5. The recliner chair defined in claim 3 wherein said footrest linkage has means for pulling the upholstery layer when the footrest linkage is in retracted position.

6. The recliner chair defined in claim 4 wherein said footrest linkage has means for pulling the upsholstery layer when the footrest linkage is in retracted position.

7. The recliner chair as defined in claim 3 wherein said footrest linkage includes a first four bar linkage connected to the seat and connected to the first and second footrest frames.

8. The recliner chair defined in claim 7 wherein said footrest linkage includes a second four bar linkage.

9. The recliner chair defined in claim 5 wherein said footrest linkage includes two four bar linkages interconnecting the seat and the second footrest frame.

10. The recliner chair defined in claim 7 wherein said footrest linkage includes a first link 244 included in said four bar linkage and pivotally connected to said first frame 218, a second link 252 pivotally connected to said second frame 220 and a link 236 of the four bar linkage, said linkage 236 also being connected to said first link 244, a third link 256 pivotally interconnecting said first frame 218 and said second link 252, a fourth link 254 pivotally interconnecting said third link and said first frame, and a fifth link pivotally interconnected between said fourth link and said second frame.

11. The recliner chair defined in claim 3 including a second layer of upholstery connected to the first footrest frame.

* * * * *